US007103195B1

(12) United States Patent
Kawata et al.

(10) Patent No.: US 7,103,195 B1
(45) **Date of Patent: *Sep. 5, 2006**

(54) SPEAKER UNIT

(75) Inventors: Tomohiro Kawata, Yamagata-ken (JP); Kunio Mitobe, Yamagata-ken (JP)

(73) Assignee: Pioneer Corporation, Tokyo (JP)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 08/931,615

(22) Filed: Sep. 16, 1997

(30) Foreign Application Priority Data

Sep. 17, 1996 (JP) ..... 8-266684

(51) Int. Cl.
*H04R 25/00* (2006.01)

(52) U.S. Cl. ..... 381/412; 381/422; 381/423; 381/433

(58) Field of Classification Search ..... 381/420, 381/412, 414, 419–423, 386, FOR. 159, 381/432, 433, 396, 398; 335/222, 302; 181/157, 181/171, 173, 198, 199
See application file for complete search history.

(56) References Cited

U.S. PATENT DOCUMENTS 3,079,472 A * 2/1963 Sariti ..... 381/420
4,969,196 A * 11/1990 Nakamura ..... 381/386

FOREIGN PATENT DOCUMENTS

| | | | |
|---|---|---|---|
| GB | 2278251 | * 11/1994 | ..... 381/FOR. 159 |
| JP | 355118299 | * 9/1980 | ..... 381/FOR. 159 |
| JP | 405207590 | * 8/1993 | ..... 381/FOR. 159 |

* cited by examiner

*Primary Examiner*—Huyen Le
(74) *Attorney, Agent, or Firm*—Drinker Biddle & Reath LLP

(57) ABSTRACT

There is provided a speaker unit comprising: an elliptical vibrating diaphragm; a cylindrical voice coil secured at one end thereof on the center of the elliptical vibrating diaphragm; a frame structure for movably supporting the vibrating diaphragm, said frame structure being formed into a rectangular or elliptical shape and having a through hole in the center thereof; a magnetic circuit formed by (1) a top plate having a rectangular shape and having a through hole in the center thereof, (2) a plate-shaped magnet having a rectangular shape and having a through hole in the center thereof, (3) a back plate having a rectangular shape and having an upright pole on the center thereof. In this speaker unit, the top plate, the plate-shaped magnet and the back plate each has a width which is narrower than that of the frame structure in its shorter axis.

21 Claims, 5 Drawing Sheets

SPEAKER UNIT

BACKGROUND OF THE INVENTION

The present invention relates to a speaker unit, in particular to a speaker unit which is thin in thickness and has an elliptical shape.

There has been known a thin type speaker unit which is for use in a television set and whose vibrating diaphragm is usually formed into an elliptical shape. On the other hand, it is usually required that a magnetic circuit of a speaker unit be formed in a manner such that it can provide a uniform magnetic flux to the surface of a cylindrical voice coil. Accordingly, it is often required that a top plate and a permanent magnet each having a circular doughnut shape be used so that the whole magnetic circuit has a cylindrical shape.

In fact, a thin type speaker unit usually has a magnetic circuit whose outer diameter is equal to or smaller than a width in a short axis direction of a frame structure which supports a vibrating diaphragm. In this way, a speaker unit as a whole may be made smaller, thus meeting with a requirement of making a compact speaker unit.

However, in a thin type speaker unit as above related, since a magnetic circuit has to be made small in size due to a restriction caused by a width in the short axis direction of a vibrating diaphragm, the magnetic flux to be applied to the surface of a voice coil will have a low density, resulting in a problem that the speaker unit has only a low sensitivity.

SUMMARY OF THE INVENTION

It is an object of the present invention to provide an improved speaker unit so as to solve the above-mentioned problem peculiar to the above-mentioned prior art.

According to the present invention, there is provided a speaker unit comprising: an elliptical vibrating diaphragm; a cylindrical voice coil secured at one end thereof on the center of the elliptical vibrating diaphragm; a frame structure for movably supporting the vibrating diaphragm, said frame structure being formed into a rectangular or elliptical shape and having a through hole in the center thereof; a magnetic circuit formed by (1) a top plate having a rectangular shape and having a through hole in the center thereof, (2) a plate-shaped magnet having a rectangular shape and having a through hole in the center thereof, (3) a back plate having a rectangular shape and having an upright pole on the center thereof. In this speaker unit, the top plate, the plate-shaped magnet and the back plate each has a width which is narrower than that of the frame structure in its shorter axis.

According to one aspect of the present invention, the frame structure, the top plate, the plate-shaped magnet and the back plate are arranged in parallel relation with one another.

The above objects and features of the present invention will become more understood from the following description with reference to the accompanying drawings.

DETAILED DESCRIPTION OF THE PREFERRED EMBODIMENTS

Figure 1:
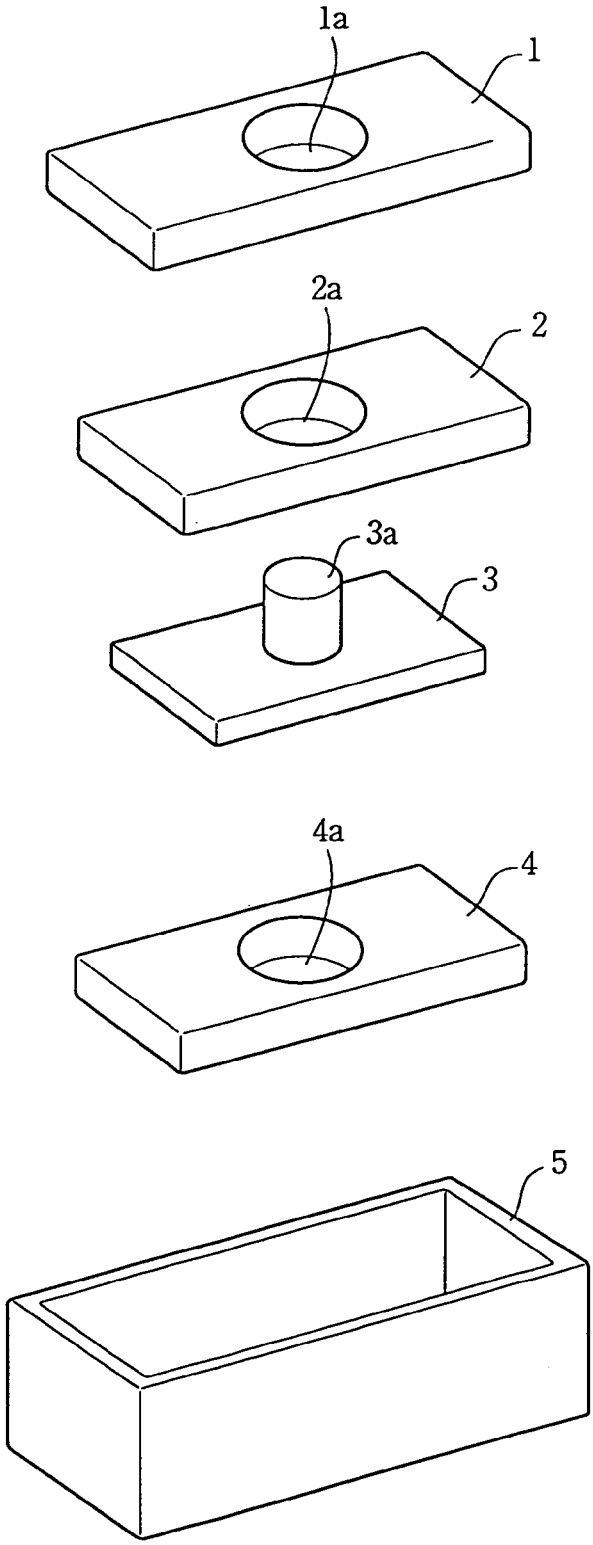
FIG. 1 is an exploded perspective view showing a series of elements for forming a magnetic circuit for use in a speaker unit according to the present invention.

Referring to FIG. 1, reference numeral 1 represents a rectangular top plate which is made of a magnetic material and has a center hole 1*a*. Reference numeral 2 represents a rectangular plate-shaped magnet having a center hole 2*a*. Reference numeral 3 represents a back plate 3 made of a magnetic material and having a center pole 3*a* smaller in diameter than hole 1*a*. Reference numeral 4 represents another plate-shaped magnet having a central hole 4*a*. The magnet 4 is used to cancel leaked magnetic flux from the magnet 2. Reference numeral 5 represents a case made of a magnetic material for receiving the top plate 1, the magnet 2, the back plate 3 and the magnet 4.

In use, the top plate 1 serves as a lid to cooperate with the case 5 so as to receive the magnet 2, the back plate 3 and the magnet 4. In this way, magnetic flux possibly leaked from the magnet 2 will be effectively blocked so as to be confined within the case 5.

Figure 2:
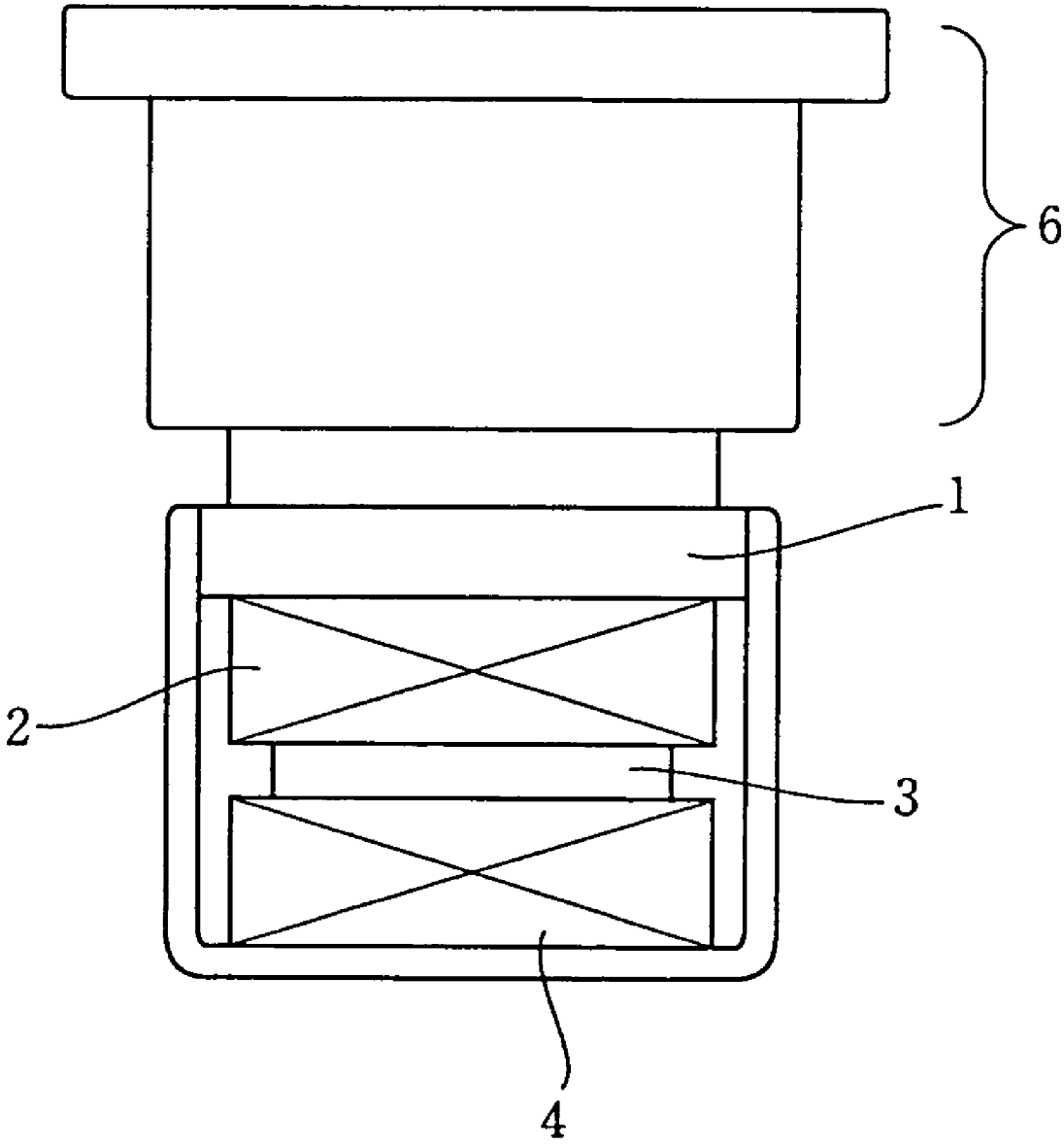
FIG. 2 is an end view showing a speaker unit of the present invention in its shorter axis.
Figure 3:
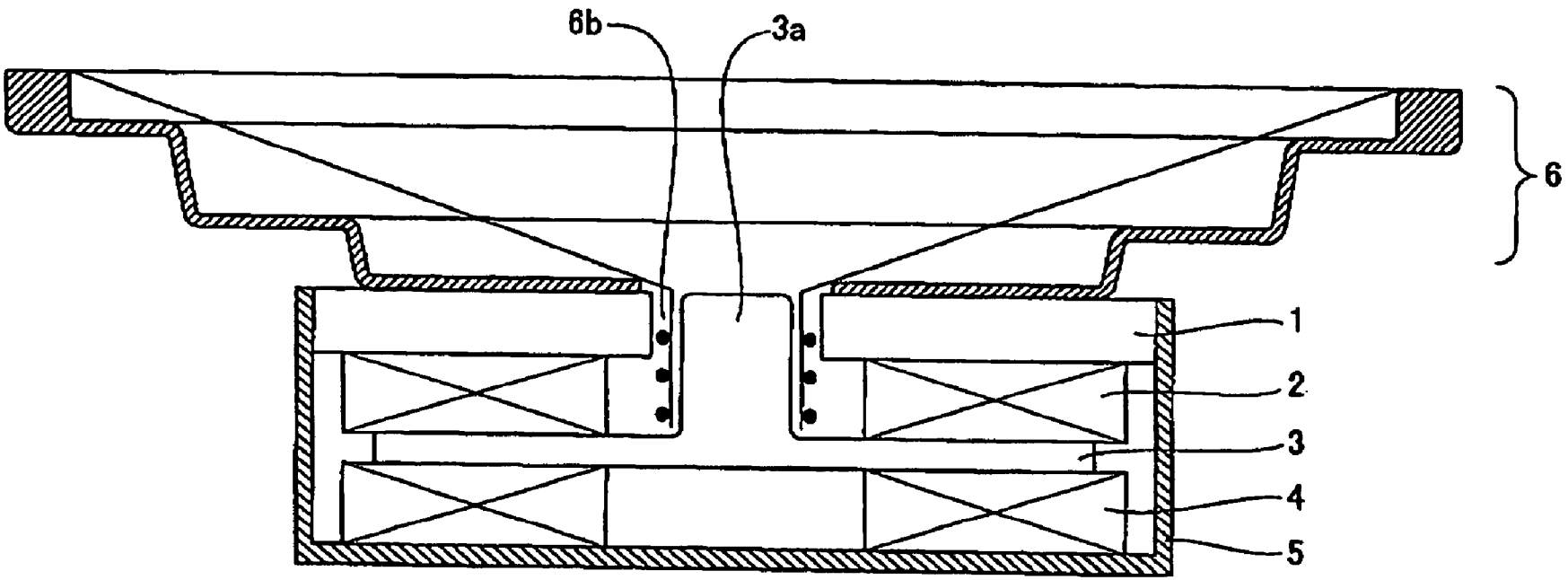
FIG. 3 is a side view showing a speaker unit of the present invention in its longer axis.
Figure 4:
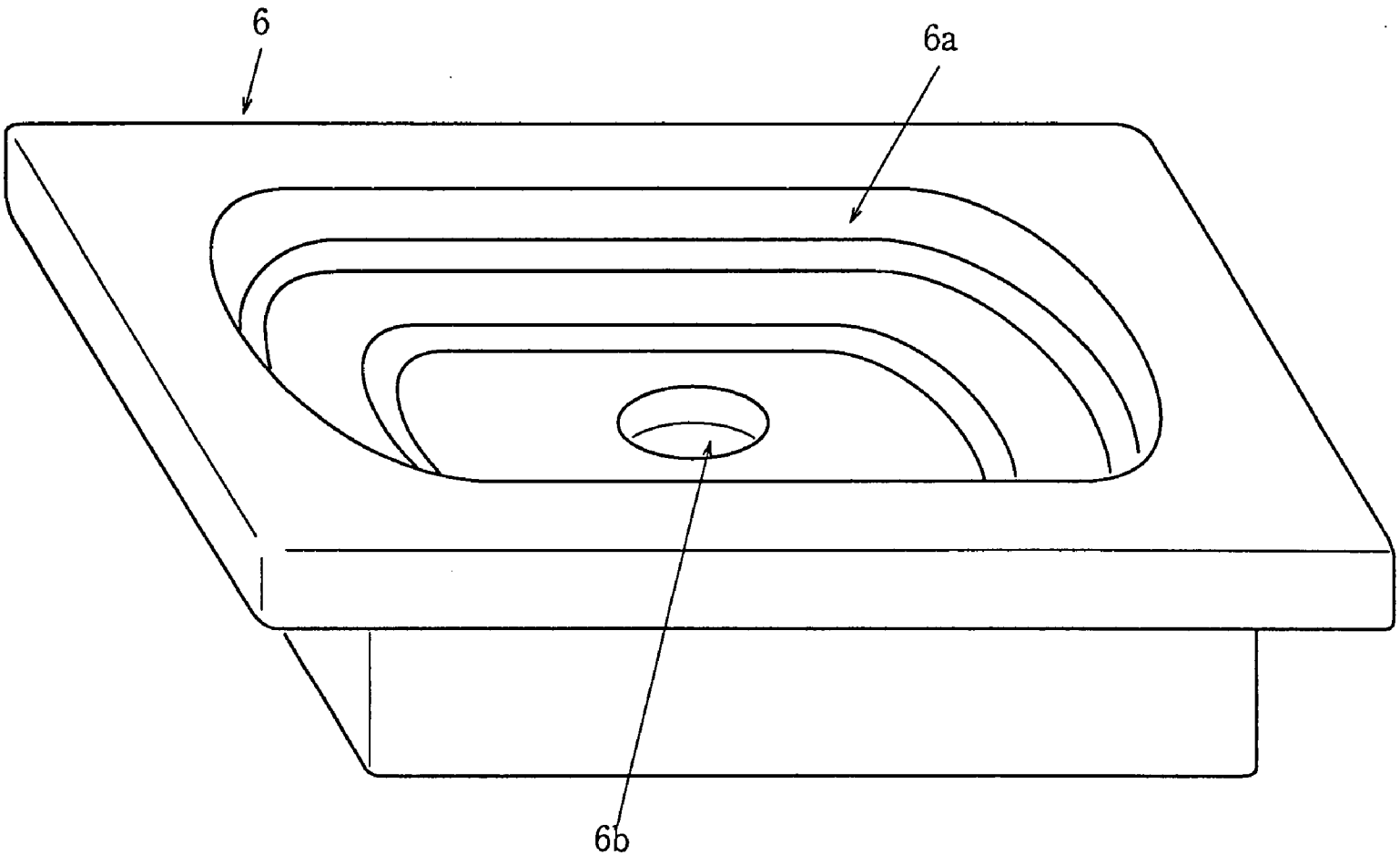
FIG. 4 is a perspective view showing a frame for use in the speaker unit of the present invention.

Referring to FIGS. 2–4, reference numeral 6 represents a rectangular parallelepiped frame structure which is used to movably support an elliptical vibrating diaphragm (not shown). As shown in FIG. 4, the frame structure 6 is formed with a elliptical recess portion 6*a* for receiving an elliptical vibrating diaphragm. Further, a center hole 6*b*, which has the same diameter as that of the center hole 1*a* of the top plate 1, is formed on the bottom of the elliptical recess portion 6*a*.

Referring again to FIGS. 1 and 3, the frame structure 6, the top plate 1, the magnet 2, the back plate 3 and the magnet 4 are assembled together with their longer axes arranged in parallel with one another.

Referring to FIG. 3, the frame structure 6 is the longest in length.

After being assembled into a condition as shown in FIG. 3, the hole 1*a* of the top plate 1, the hole 2*a* of the magnet 2, the hole 4*a* of the magnet 4 and the hole 6*a* of the frame structure 6 are all aligned in a vertical line so that the centers of these holes become coincident with one another, thereby permitting the center pole 3*a* of the back plate 3 to be inserted through all these holes. In this way, a magnetic circuit is formed by virtue of the top plate 1, the magnet 2 and the back plate 3. A magnetic gap is formed in an annular space formed between the inner wall of the hole 1*a* and the surface of the center pole 3*a*. A cylindrical voice coil having one end thereof fixed at the center of a vibrating diaphragm is inserted in the annular space.

Referring to FIG. 2, the frame structure 6 has a larger width than the top plate 1, the magnet 2 and the back plate 3. As compared with a conventional speaker unit where a doughnut-shaped magnet is used to form a cylindrical magnetic circuit, since the magnet 2 in the present invention has a larger volume than that in prior art, the magnetic flux to be applied to the voice coil will have a larger density. Further, since the magnetic circuit in the present invention is shorter in its longer axis and narrower in its shorter axis than the frame structure 6, a cabinet (into which the speaker unit is to be received) is required to have only a small volume which may be the same as that of a cabinet for a conventional speaker unit (having a cylindrical magnetic circuit), but achieving a higher sensitivity than a conventional speaker unit.

Figure 5A:
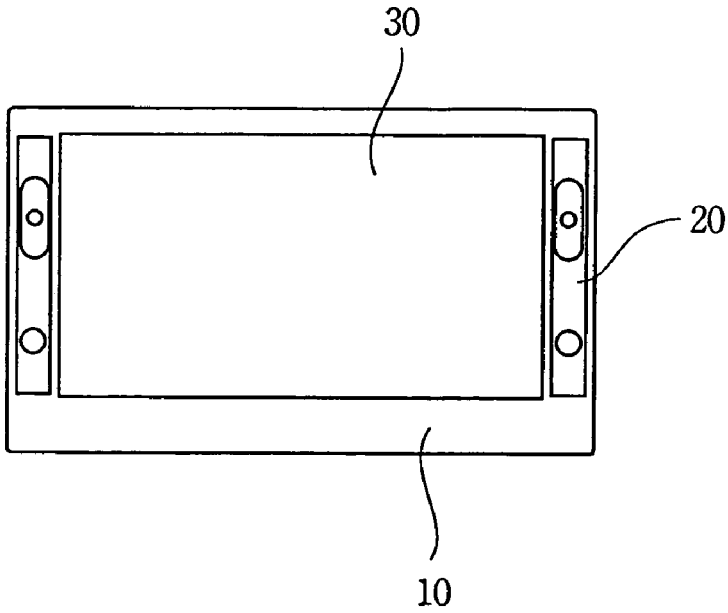
FIG. 5*a* is a front view showing a television set in which the speaker unit of the present invention is applied.
Figure 5B:
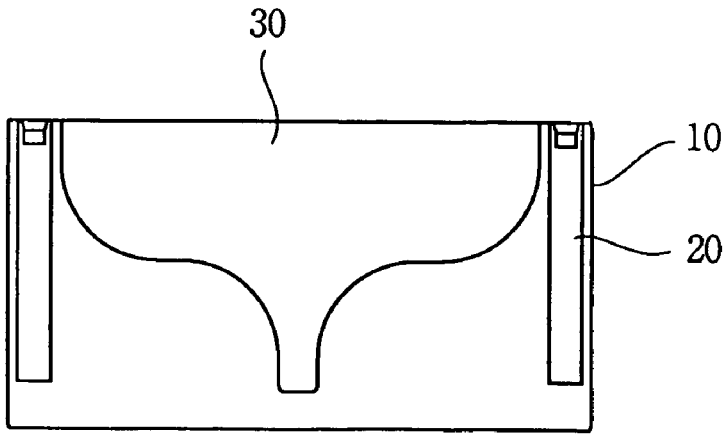
FIG. 5*b* is a top plane view showing the television set of FIG. 5*a*.

FIG. 5*a* is a front view and FIG. 5*b* is a top plane view, showing an example where the speaker unit of the present invention is installed in a television set. As shown in FIG. 5*a*, the television set comprises a frame 10 holding a display 30. Provided on either side of the display 30 is a speaker unit 20 manufactured in accordance with the present invention. It has been found that the speaker unit of the present invention is particularly suitable for use in a television set in which there is only an elongate narrow space for installing a speaker unit.

It is understood from the above description that with the use of the present invention, the magnet of a speaker unit is allowed to be made larger than prior art so that the magnetic flux to be applied to the voice coil will have a higher density than prior art, thereby enabling a speaker unit to obtain an improved sensitivity.

Further, since the magnetic circuit in the present invention is shorter in its longer axis and narrower in its shorter axis than a frame structure for supporting a vibrating diaphragm, a cabinet (into which the speaker unit is to be received) is required to have only a small volume which may be the same as that of a cabinet for a conventional speaker unit (having a cylindrical magnetic circuit), but achieving a higher sensitivity than a conventional speaker unit.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A speaker unit comprising:

an elliptical vibrating diaphragm;

a cylindrical voice coil having a circular cross-section and secured at one end thereof on a center of the elliptical vibrating diaphragm;

a rectangular frame for movably supporting the vibrating diaphragm and having a through hole in its center;

a magnetic circuit formed by a top plate having a rectangular shape and having a through hole in its center, a plate-shaped magnet having a rectangular shape and having a circular through hole in its center, and a back plate having a rectangular shape and having an integrally formed upright pole on its center, wherein each of the top plate, the plate-shaped magnet and the back plate has a width and a length, each width being substantially less than each respective length, thereby permitting installation of the speaker unit in a narrow space, wherein the top plate, the plate-shaped magnet and the back plate each has a width that is equal to or narrower than a width of the rectangular frame in its shorter axis, wherein the top plate, the plate-shaped magnet and the back plate each has a length that is equal to or shorter than a length of the rectangular frame in its longer axis, wherein the rectangular frame is mounted on the top plate and formed with a through hole on its bottom for inserting the voice coil into a magnetic gap formed between the through hole of the top plate and the integrally formed pole of the back plate, wherein the top plate, the plate-shaped magnet and the back plate are all accommodated in a case made of a magnetic material, with the top plate serving as a cap for the case, wherein the rectangular frame presents a rectangular shape when looked at in plan view, wherein the hole formed in the center of the top plate defines a constant and continuous radius, wherein the rectangular frame has a stepped interior surface and an upper lip overhanging beyond the outer perimeters of the top plate, the plate-shaped magnet, and the back plate, wherein the stepped interior surface comprises a first horizontal surface that is substantially parallel to a top surface of the top plate, a second horizontal surface, located further from the top plate than the first horizontal surface, that is substantially parallel to the top surface of the top plate, a third horizontal surface, located further from the top plate than the second horizontal surface, that is substantially parallel to the top surface of the top plate, a first substantially vertical surface coupling the first horizontal surface to the second horizontal surface, and a second substantially vertical surface coupling the second horizontal surface to the third horizontal surface, and wherein the outer perimeter of the top plate extends beyond an outer perimeter of the first horizontal surface and the first substantially vertical surface.

2. The speaker unit according to claim 1, wherein the frame structure, the top plate, the plate-shaped magnet and the back plate are arranged in parallel relation with one another.

3. The speaker unit according to claim 1, wherein the speaker unit is installed on either side of a television display on a television set.

4. The speaker unit according to claim 1, wherein said case is adapted to cooperate with the top plate to house the plate-shaped magnet and back plate, and has a generally rectangular parallelepiped shape having an open upper side and having a width narrower than that of the frame.

5. The speaker unit of claim 1, wherein the plate-shaped magnet includes a first plate-shaped magnet having a rectangular shape and having a circular through hole in its center and a second plate-shaped magnet on an opposite side of the back plate from the first plate-shaped magnet, the second plate-shaped magnet having a circular hole through its center.

6. The speaker unit of claim 1, wherein the magnetic circuit has the same shape as the rectangular frame.

7. A speaker unit comprising:

an elliptical vibrating diaphragm;

a cylindrical voice coil having a circular cross-section and secured at one end thereof on a center of the elliptical vibrating diaphragm;

a rectangular frame with an elliptical recess portion for movably supporting the vibrating diaphragm and having a through hole in its center;

a magnetic circuit formed by a top plate having a rectangular shape and having a through hole in its center, a plate-shaped magnet having a rectangular shape and having a circular through hole in its center, and a back plate having a rectangular shape and having an integrally formed upright pole on its center, wherein each of the top plate, the plate-shaped magnet and the back plate has a width and a length, each width being substantially less than each respective length, thereby permitting installation of the speaker unit in a narrow space, wherein the top plate, the plate-shaped magnet and the back plate each has a width that is equal to or narrower than a width of the frame in its shorter axis, wherein the top plate, the plate-shaped magnet and the back plate each has a length that is equal to or shorter than a length of the frame in its longer axis;

wherein the rectangular frame is mounted on the top plate and formed with a through hole on its bottom for inserting the voice coil into a magnetic gap formed between the through hole of the top plate and the integrally formed pole of the back plate, wherein the top plate, the plate-shaped magnet and the back plate are all accommodated in a case made of a magnetic material, with the top plate serving as a cap for the case, wherein the rectangular frame presents a rectangular shape when looked at in plan view, wherein the hole formed in the center of the top plate defines a constant and continuous radius, wherein the rectangular frame has a stepped interior surface and an upper lip overhanging beyond the outer perimeters of the top plate, the plate-shaped magnet, and the back plate, wherein the stepped interior surface comprises a first horizontal surface that is substantially parallel to a top surface of the top plate, a second horizontal surface, located further from the top plate than the first horizontal surface, that is substantially parallel to the top surface of the top plate, a third horizontal surface, located further from the top plate than the second horizontal surface, that is substantially parallel to the top surface of the top plate a first substantially vertical surface coupling the first horizontal surface to the second horizontal surface, and a second substantially vertical surface coupling the second horizontal surface to the third horizontal surface, and wherein the outer perimeter of the top plate extends beyond an outer perimeter of the first horizontal surface and the first substantially vertical surface.

8. The speaker unit according to claim 7, wherein said case is adapted to cooperate with the top plate to house the plate-shaped magnet and back plate, and has a generally rectangular parallelepiped shape having an open upper side and having a width narrower than that of the frame.

9. The speaker unit according to claim 7, wherein the frame, the top plate, the plate-shaped magnet and the back plate are arranged parallel relation to one another.

10. The speaker unit according to claim 7, wherein the speaker unit is installed on either side of a television display on a television set.

11. The speaker unit of claim 7, wherein the plate-shaped magnet includes a first plate-shaped magnet having a rectangular shape and having a circular through hole in its center and a second plate-shaped magnet on an opposite side of the back plate from the first plate-shaped magnet, the second plate-shaped magnet having a circular hole through its center.

12. A speaker unit comprising:

an elliptical vibrating diaphragm;

a cylindrical voice coil having a circular cross-section and secured at one end thereof on a center of the elliptical vibrating diaphragm;

a rectangular frame for movably supporting the vibrating diaphragm and having a through hole in its center;

a rectangular magnetic circuit formed by a top plate having a rectangular shape and having a through hole in its center, a plate-shaped magnet having a rectangular shape and having a circular through hole in its center, and a back plate having a rectangular shape and having an integrally formed upright pole on its center;

wherein each of the top plate, the plate-shaped magnet and the back plate has a width and a length, each width being substantially less than each respective length, thereby permitting installation of the speaker unit in a narrow space, wherein the top plate, the plate-shaped magnet and the back plate each has a width that is narrower than a width of the rectangular frame in its shorter axis, wherein the rectangular frame is mounted on the top plate and formed with a through hole on its bottom for inserting the voice coil into a magnetic gap formed between the through hole of the top plate and the integrally formed pole of the back plate, wherein the top plate, the plate-shaped magnet and the back plate are all accommodated in a case made of a magnetic material, with the top plate serving as a cap for the case, wherein the rectangular frame presents a rectangular shape when looked at in plan view, wherein the hole formed in the center of the top plate defines a constant and continuous radius, wherein the rectangular frame has a stepped interior surface and an upper lip overhanging beyond the outer perimeters of the top plate, the plate-shaped magnet, and the back plate, wherein the stepped interior surface comprises a first horizontal surface that is substantially parallel to a top surface of the top plate, a second horizontal surface, located further from the top plate than the first horizontal surface, that is substantially parallel to the top surface of the top plate, a third horizontal surface, located further from the top plate than the second horizontal surface, that is substantially parallel to the top surface of the top plate, a first substantially vertical surface coupling the first horizontal surface to the second horizontal surface, and a second substantially vertical surface coupling the second horizontal surface to the third horizontal surface, and wherein the outer perimeter of the top plate extends beyond an outer perimeter of the first horizontal surface and the first substantially vertical surface.

13. The speaker unit of claim 12, wherein the plate-shaped magnet includes a first plate-shaped magnet having a rectangular shape and having a circular through hole in its center and a second plate-shaped magnet on an opposite side of the back plate from the first plate-shaped magnet, the second plate-shaped magnet having a circular hole through its center.

14. The speaker unit of claim 12, wherein the top plate, the plate-shaped magnet and the back plate each has a length that is equal to or shorter than a length of the rectangular frame in its longer axis.

15. A speaker unit comprising:

an elliptical vibrating diaphragm;

a cylindrical voice coil having a circular cross-section and secured at one end thereof on a center of the elliptical vibrating diaphragm;

a rectangular frame having an elliptical recess portion for movably supporting the vibrating diaphragm and having a through hole in its center;

a magnetic circuit formed by a top plate having a rectangular shape and having a through hole in its center, a plate-shaped magnet having a rectangular shape and having a circular through hole in its center, and a back plate having a rectangular shape and having an upright pole on its center, wherein each of the top plate, the plate-shaped magnet and the back plate has a width and a length, each width being substantially less than each respective length, thereby permitting installation of the speaker unit in a narrow space, wherein the top plate, the plate-shaped magnet and the back plate each has a width that is narrower than a width of the frame in its shorter axis, wherein the rectangular frame is mounted on the top plate and formed with a through hole on its bottom for inserting the voice coil into a magnetic gap formed between the through hole of the top plate and the integrally formed pole of the back plate, wherein the top plate, the plate-shaped magnet and the back plate are all accommodated in a case made of a magnetic material, with the top plate serving as a cap for the case, wherein the rectangular frame presents a rectangular shape when looked at in the plan view, wherein the hole formed in the center of the top plate defines a constant and continuous radius, wherein the rectangular frame has a stepped interior surface and an upper lip overhanging beyond the outer perimeters of the top plate, the plate-shaped magnet, and the back plate, wherein the stepped interior surface comprises a first horizontal surface that is substantially parallel to a top surface of the top plate, a second horizontal surface, located further from the top plate than the first horizontal surface, that is substantially parallel to the top surface of the top plate, a third horizontal surface, located further from the top plate than the second horizontal surface, that is substantially parallel to the top surface of the top plate, a first substantially vertical surface coupling the first horizontal surface to the second horizontal surface, and a second substantially vertical surface coupling the second horizontal surface to the third horizontal surface, and wherein the outer perimeter of the top plate extends beyond an outer perimeter of the first horizontal surface and the first substantially vertical surface.

16. The speaker unit of claim 15, wherein the top plate, the plate-shaped magnet and the back plate each has a length that is equal to or shorter than a length of the frame in its longer axis.

17. A speaker unit comprising:

an elliptical vibrating diaphragm;

a cylindrical voice coil having a circular cross-section and secured at one end thereof on a center of the elliptical vibrating diaphragm;

a rectangular frame for movably supporting the vibrating diaphragm and having a through hole in its center;

a magnetic circuit formed by a top plate having a rectangular shape and having a through hole in its center, a first plate-shaped magnet having a rectangular shape and having a circular through hole in its center, and a back plate having a rectangular shape and having an integrally formed upright pole on its center; and a second plate-shaped magnet on an opposite side of the back plate from the first plate-shaped magnet, wherein each of the top plate, the plate-shaped magnet and the back plate has a width and a length, each width being substantially less than each respective length, thereby permitting installation of the speaker unit in a narrow space, wherein the top plate, the plate-shaped magnet and the back plate each has a width that is narrower than a width of the rectangular frame in its shorter axis, wherein the rectangular frame is mounted on the top plate and formed with a through hole on its bottom for inserting the voice coil into a magnetic gap formed between the through hole of the top plate and the integrally formed pole of the back plate, wherein the top plate, the plate-shaped magnet and the back plate are all accommodated in a case made of a magnetic material, with the top plate serving as a cap for the case, wherein the rectangular frame presents a rectangular shape when looked at in the plan view, wherein the hole formed in the center of the top plate defines a constant and continuous radius, wherein the rectangular frame has a stepped interior surface and an upper lip overhanging beyond the outer perimeters of the top plate, the plate-shaped magnet, and the back plate, wherein the stepped interior surface comprises a first horizontal surface that is substantially parallel to a top surface of the top plate, a second horizontal surface, located further from the top plate than the first horizontal surface, that is substantially parallel to the top surface of the top plate, a third horizontal surface, located further from the top plate than the second horizontal surface, that is substantially parallel to the top surface of the top plate, a first substantially vertical surface coupling the first horizontal surface to the second horizontal surface, and a second substantially vertical surface coupling the second horizontal surface to the third horizontal surface, and wherein the outer perimeter of the top plate extends beyond an outer perimeter of the first horizontal surface and the first substantially vertical surface.

18. The speaker unit of claim 17, wherein the top plate, the plate-shaped magnet and the back plate each has a length that is equal to or shorter than a length of the rectangular frame in its longer axis.

19. The speaker unit of claim 17, wherein the magnetic circuit has the same shape as the rectangular frame.

20. A speaker unit comprising:

an elliptical vibrating diaphragm;

a cylindrical voice coil having a circular cross-section and secured at one end thereof on a center of the elliptical vibrating diaphragm;

a rectangular frame having an elliptical recess portion for movably supporting the vibrating diaphragm and having a through hole in its center;

a magnetic circuit formed by a top plate having a rectangular shape and having a through hole in its center, a first plate-shaped magnet having a rectangular shape and having a circular through hole in its center, a back plate having a rectangular shape and having upright pole on its center, and a second plate-shaped magnet on an opposite side of the back plate from the first plate-shaped magnet, wherein each of the top plate, the plate-shaped magnet and the back plate has a width and a length, each width being substantially less than each respective length, thereby permitting installation of the speaker unit in a narrow space, wherein the top plate, the plate-shaped magnet and the back plate each has a width that is narrower than a width of the frame in its shorter axis, wherein the rectangular frame is mounted on the top plate and formed with a through hole on its bottom for inserting the voice coil into a magnetic gap formed between the through hole of the top plate and the integrally formed pole of the back plate, wherein the top plate, the plate-shaped magnet and the back plate are all accommodated in a case made of a magnetic material, with the top plate serving as a cap for the case, wherein the rectangular frame presents a rectangular shape when looked at in plan view, wherein the hole formed in the center of the top plate defines a constant and continuous radius, wherein the rectangular frame has a stepped interior surface and an upper lip overhanging beyond the outer perimeters of the top plate, the plate-shaped magnet, and the back plate, wherein the stepped interior surface comprises a first horizontal surface that is substantially parallel to a top surface of the top plate, a second horizontal surface, located further from the top plate than the first horizontal surface, that is substantially parallel to the top surface of the top plate, a third horizontal surface, located further from the top plate than the second horizontal surface, that is substantially parallel to the top surface of the top plate, a first substantially vertical surface coupling the first horizontal surface to the second horizontal surface, and a second substantially vertical surface coupling the second horizontal surface to the third horizontal surface, and wherein the outer perimeter of the top plate extends beyond an outer perimeter of the first horizontal surface and the first substantially vertical surface.

21. The speaker unit of claim 20, wherein the top plate-shaped magnet and the back plate each has a length that is equal to or shorter than a length of the frame in its longer axis.

* * * * *

UNITED STATES PATENT AND TRADEMARK OFFICE

CERTIFICATE OF CORRECTION

PATENT NO. : 7,103,195 B1
APPLICATION NO. : 08/931615
DATED : September 5, 2006
INVENTOR(S) : Kawata et al.

It is certified that error appears in the above-identified patent and that said Letters Patent is hereby corrected as shown below:

Title Page, Item (73)
(73) Assignee: "Pioneer Corporation, Tokyo (JP)" should be --Pioneer Electronic Corporation, Tokyo (JP) and Tohoku Pioneer Electronic Corporation, Yamagata-ken (JP)--.

Signed and Sealed this

Twenty-seventh Day of April, 2010

David J. Kappos

David J. Kappos
*Director of the United States Patent and Trademark Office*